US012668855B2

(12) United States Patent
Minoura et al.

(10) Patent No.: US 12,668,855 B2
(45) Date of Patent: Jun. 30, 2026

(54) METAL REMOVAL METHOD AND METAL RECOVERY METHOD

(71) Applicants: KABUSHIKI KAISHA TOYOTA CHUO KENKYUSHO, Nagakute (JP); TOYOTA TSUSHO CORPORATION, Nagoya (JP)

(72) Inventors: Takuma Minoura, Nagakute (JP); Jun Yaokawa, Nagakute (JP); Kazuma Hibi, Nagakute (JP); Hiroshi Kawahara, Nagakute (JP); Yasushi Iwata, Nagakute (JP); Hiroyuki Ishii, Toyota (JP); Akira Kano, Toyota (JP); Yusei Kusaka, Toyota (JP); Kyosuke Ito, Toyota (JP); Tomoo Murata, Tahara (JP)

(73) Assignees: KABUSHIKI KAISHA TOYOTA CHUO KENKYUSHO, Nagakute (JP); TOYOTA TSUSHO CORPORATION, Nagoya (JP)

( * ) Notice: Subject to any disclaimer, the term of this patent is extended or adjusted under 35 U.S.C. 154(b) by 707 days.

(21) Appl. No.: 17/790,610

(22) PCT Filed: Jan. 11, 2021

(86) PCT No.: PCT/JP2021/000594
§ 371 (c)(1),
(2) Date: Jul. 1, 2022

(87) PCT Pub. No.: WO2021/145293
PCT Pub. Date: Jul. 22, 2021

(65) Prior Publication Data

US 2023/0043661 A1 Feb. 9, 2023

(30) Foreign Application Priority Data

Jan. 15, 2020 (JP) ..... 2020-004697

(51) Int. Cl.
*C22B 21/06* (2006.01)
*C22B 21/04* (2006.01)
*C22B 26/22* (2006.01)

(52) U.S. Cl.
CPC ..... *C22B 21/062* (2013.01); *C22B 21/04* (2013.01); *C22B 26/22* (2013.01)

(58) Field of Classification Search
None
See application file for complete search history.

(56) References Cited

U.S. PATENT DOCUMENTS 1,975,084 A 10/1934 Vail
4,097,270 A 6/1978 Rao et al.
(Continued)

FOREIGN PATENT DOCUMENTS

CN 103740948 A 4/2014
CN 110616348 A 12/2019
(Continued)

OTHER PUBLICATIONS

Apr. 20, 2021 International Search Report issued in International Patent Application No. PCT/JP2021/000594.
(Continued)

*Primary Examiner* — Jenny R Wu
(74) *Attorney, Agent, or Firm* — Oliff PLC

(57) ABSTRACT

A method with which Mg can be removed from aluminum alloy melt whose raw material is scrap or the like. Metal removal method includes processing step of forming molten salt layer in contact with aluminum alloy melt containing Mg which covers at least part of the surface of the aluminum alloy melt. This method allows Mg to be taken in from aluminum alloy melt to molten salt layer and removed. Molten salt layer contains specific halogen element that is one or more of Cl or Br and specific metal element that is
(Continued)

one or more of Cu, Zn, or Mn. The specific metal element is supplied as an oxide of the specific metal element to the molten salt layer. At that time, the molten salt layer contains Mg. The step of removing Mg is performed by disposing a conductor that bridges the aluminum alloy melt and the molten salt layer.

10 Claims, 10 Drawing Sheets

(56) References Cited

U.S. PATENT DOCUMENTS

| | | | | |
|---|---|---|---|---|
| 4,183,745 | A * | 1/1980 | Tsumura | C22B 21/062 205/405 |
| 5,405,427 | A | 4/1995 | Eckert | |
| 5,500,100 | A * | 3/1996 | Riley | C22B 26/22 205/404 |
| 2010/0307293 | A1 | 12/2010 | Tremblay et al. | |
| 2012/0121890 | A1 | 5/2012 | Weiland et al. | |
| 2023/0030521 | A1 | 2/2023 | Hibi et al. | |
| 2023/0070997 | A1 | 3/2023 | Yaokawa et al. | |

FOREIGN PATENT DOCUMENTS

| | | | |
|---|---|---|---|
| GB | 451271 | A | 6/1935 |
| JP | S59-059846 | A | 4/1984 |
| JP | 2007-154268 | A | 6/2007 |
| JP | 2008-050637 | A | 3/2008 |
| JP | 2011-168830 | A | 9/2011 |
| JP | 2012-529565 | A | 11/2012 |
| JP | 2017-122257 | A | 7/2017 |
| SU | 1008261 | A1 * | 3/1983 |

OTHER PUBLICATIONS

Apr. 20, 2021 Written Opinion issued in International Patent Application No. PCT/JP2021/000594.
Apr. 12, 2022 Office Action issued in Japanese Patent Application No. 2020-004697.
Tsunekawa, Masanori, "Refining Processes of Molten Aluminium Using Solid Flux," Journal of Japan Institute of Light Metals, vol. 54, No. 2, pp. 75-81, 2004.
Nagayama et al., "Demagging Processes By Fluxing From Aluninum Alloys," Journal of Japan Institute of Light Metals, vol. 33, No. 5, pp. 243-248, 1983.
Nov. 9, 2023 Office Action Issued in Chinese Patent Application No. 202180009207.3.
Deqin et al., "Mg Element Removing Technology from AI Slag Melts," Special Casting and Non-Ferrous Alloys, 2015, p. 1020-1023, vol. 35, Issue 10.
Jiaxiang, "Q&A on Aluminum Alloy Melting and Casting Production Technology," Beijing: Metallurgical Industry Press, 2008, p. 117-118.
Apr. 26, 2023 Office Action issued in Chinese Patent Application No. 202180009207.3.
Nagayama et al., "Demagging processes by fluxing from aluminum alloys," Journal of Japan Institute of Light Metals, vol. 33, No. 5, pp. 243-248, 1983.
Tsunekawa, "Refining processes of molten aluminum using solid flux," Journal of Japan Institute of Light Metals, vol. 54, No. 2, pp. 75-81, 2004.
Potassium Chloride, Sep. 3, 2018, The Chemical Company (Year: 2018).
Gendelman Mikhail YA: Apanasenko Anatolij M. Su 1008261 A1 Supplemental Espacenet Machine Translation translated 2023, originally published Mar. 30, 1983 (Year: 2023).
Jun. 22, 2023 Office Action issued in U.S. Appl. No. 17/862,598.
May 26, 2023 Office Action issued in Chinese Patent Application No. 202210809300.9.
Feb. 16, 2024 Office Action issued in U.S. Appl. No. 17/862,598.
Mar. 16, 2021 International Search Report issued in International Patent Application No. PCT/JP2021/000593.
Mar. 16, 2021 Written Opinion issued in International Patent Application No. PCT/JP2021/000593.
Apr. 12, 2022 Office Action issued in Japanese Patent Application No. 2020-004693.
May 24, 2024 Office Action issued in Chinese Patent Application No. 202180009195.4.
Oct. 18, 2024 Office Action issued in U.S. Appl. No. 17/790,660.
U.S. Appl. No. 17/790,660, filed Jul. 1, 2022, in the name of Yaokawa et al.
U.S. Appl. No. 17/862,598, filed Jul. 12, 2022, in the name of Hibi et al.
Jan. 13, 2025 Office Action in U.S. Appl. No. 17/862,598.
Mar. 11, 2025 Notification of Resons for Refusal issued in Japanese Patent Application No. 2021-115954.
Feb. 25, 2025 Office Action issued in U.S. Appl. No. 17/790,660.
NPL: on-line translation of SU-1008261-A, Mar. 1983 (Year: 1983).
Aug. 7, 2025 Office Action issued in U.S. Appl. No. 17/790,660.

* cited by examiner

[Fig. 1A]
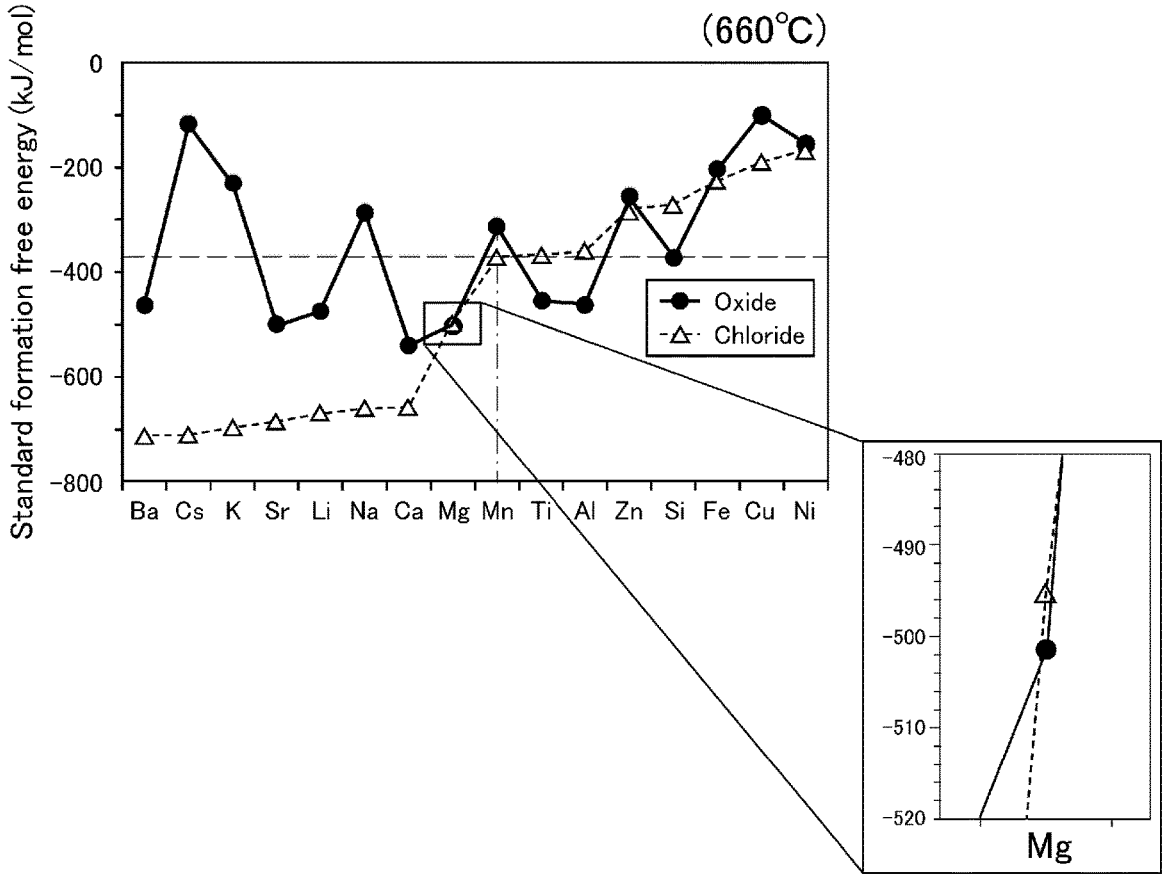
[Fig. 1B]
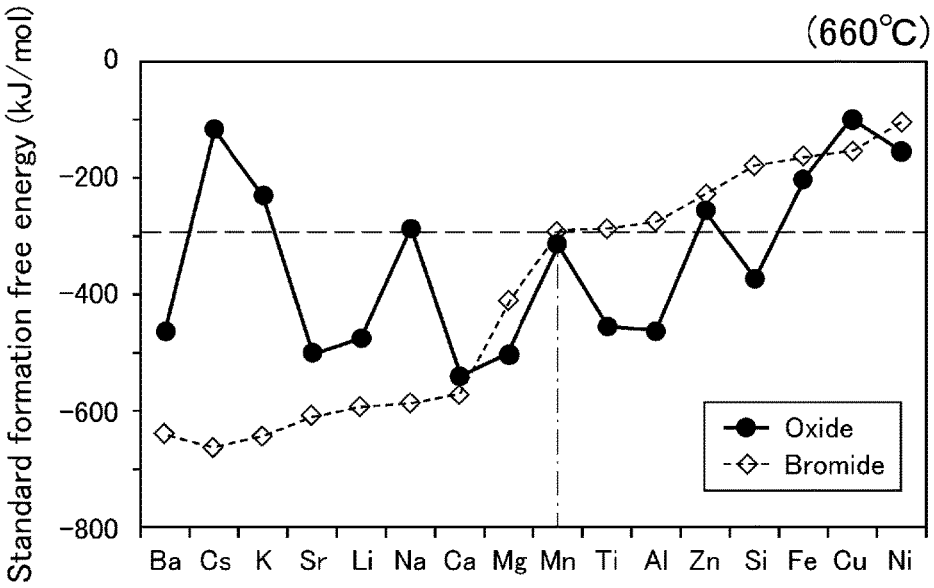

[Fig. 2A]
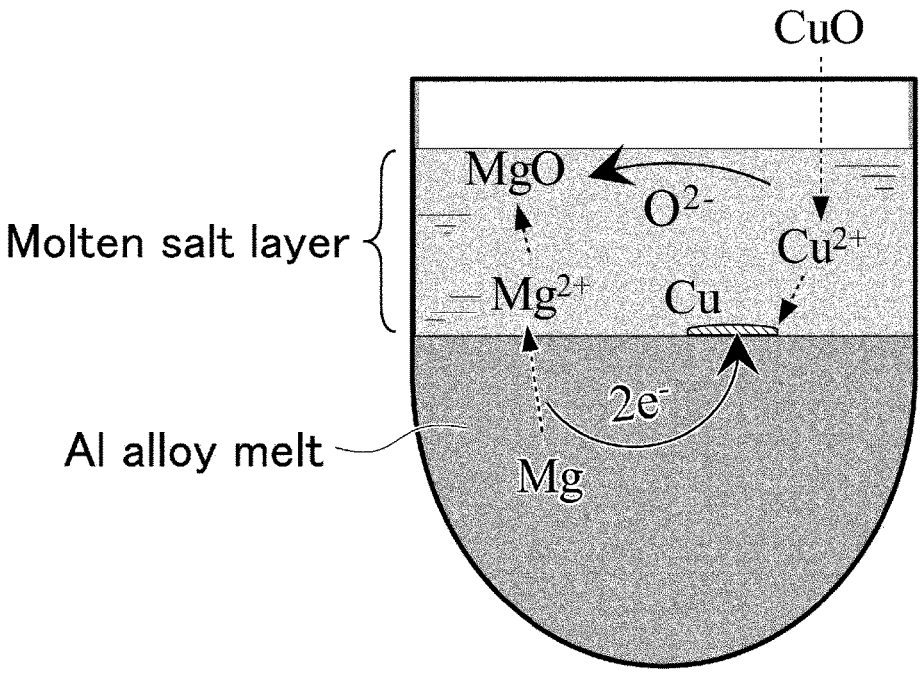
[Fig. 2B]
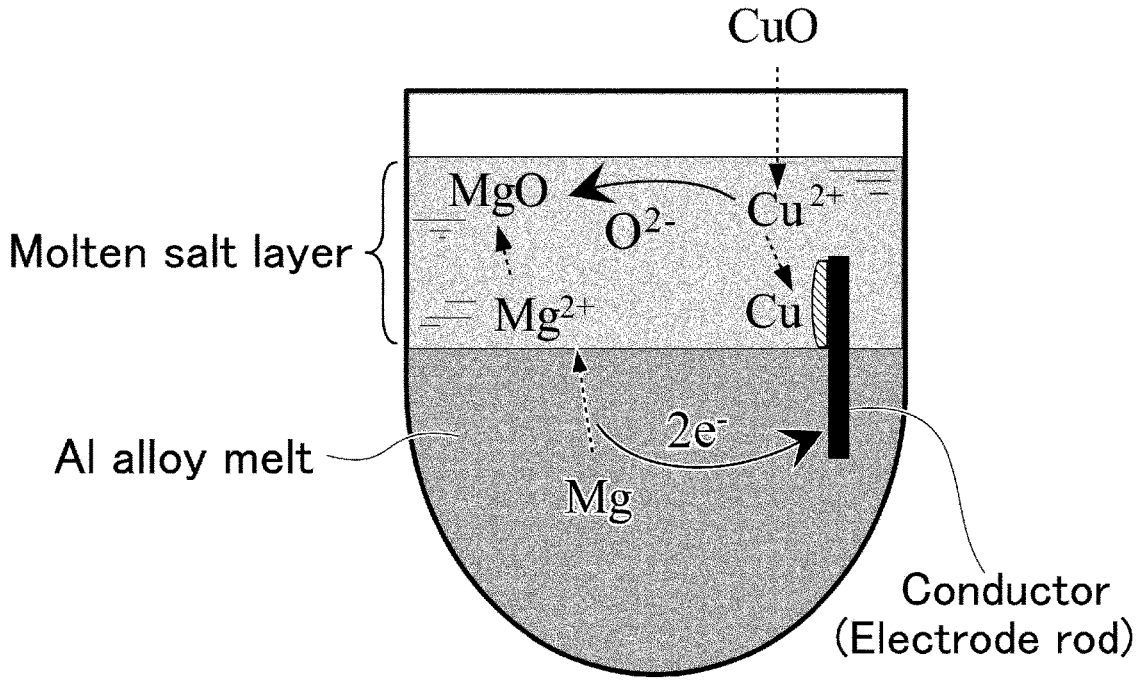

[Fig. 3A]
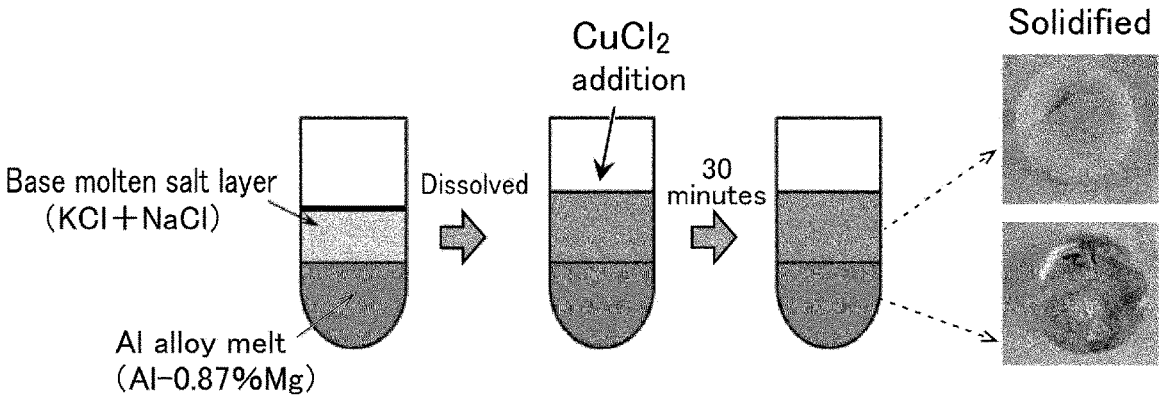
[Fig. 3B]
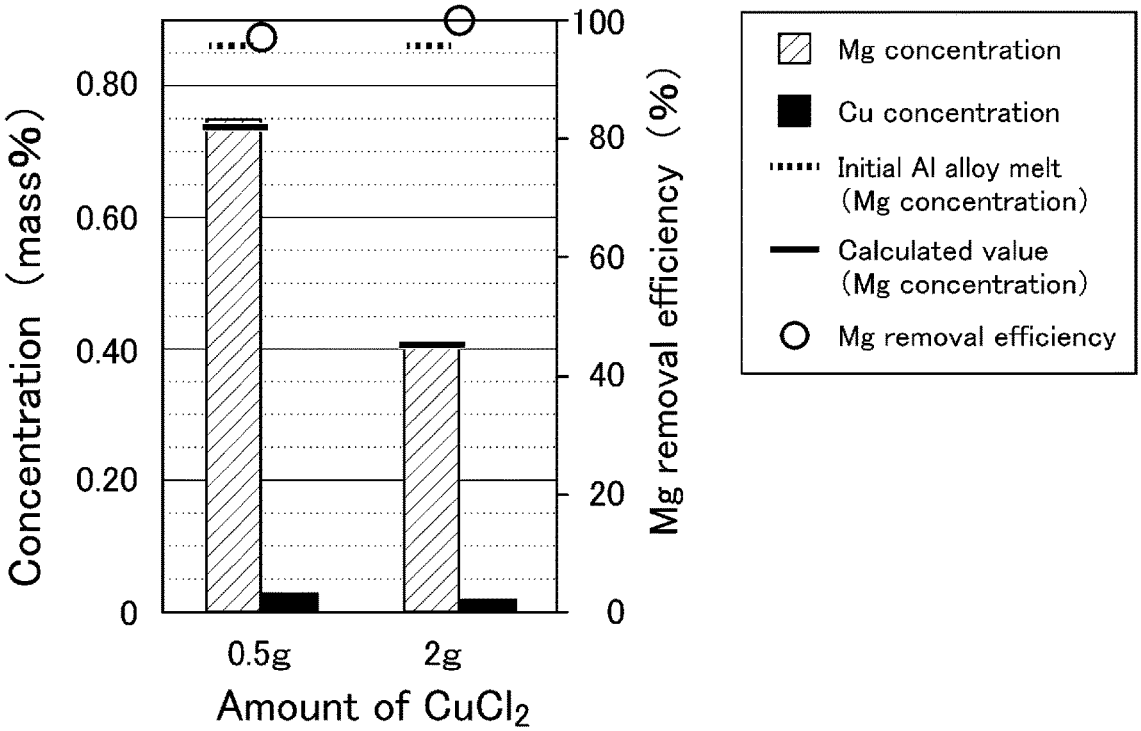

[Fig. 4A]
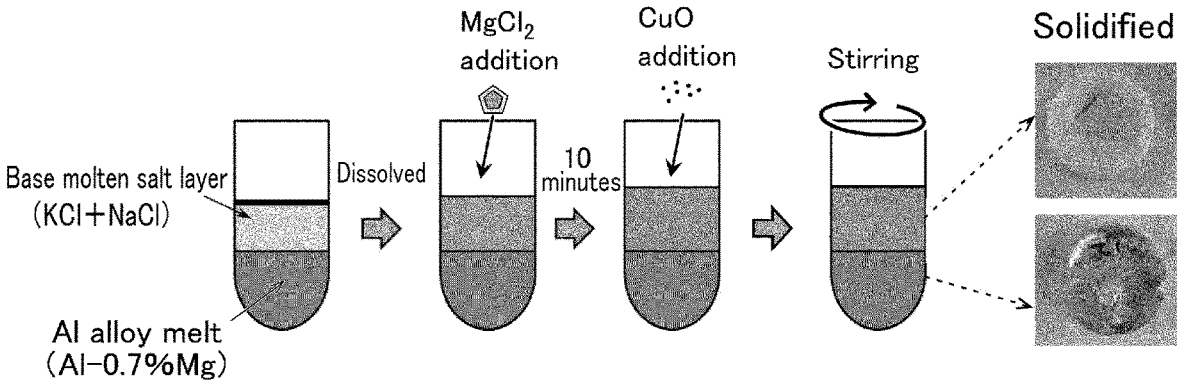
[Fig. 4B]
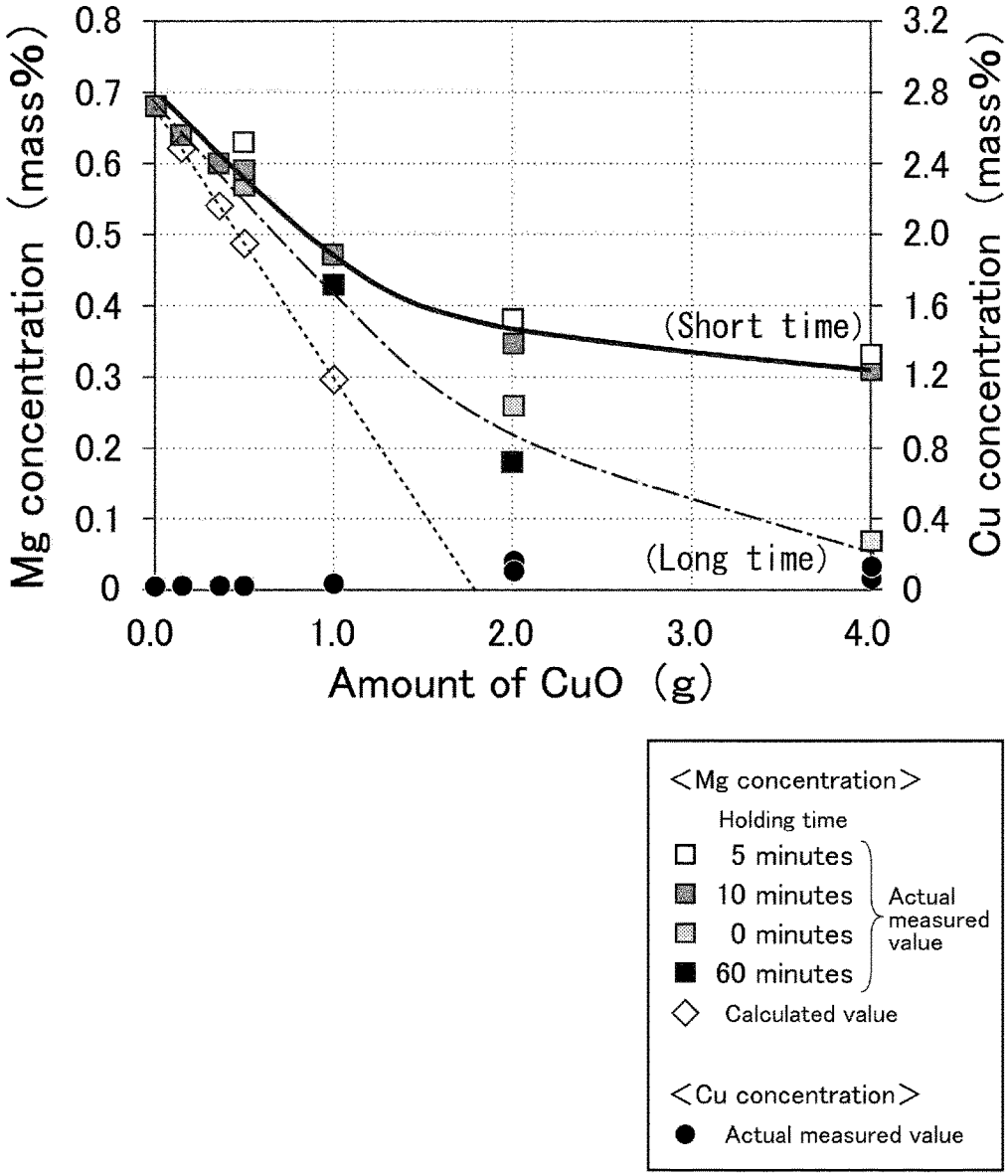

[Fig. 4C]
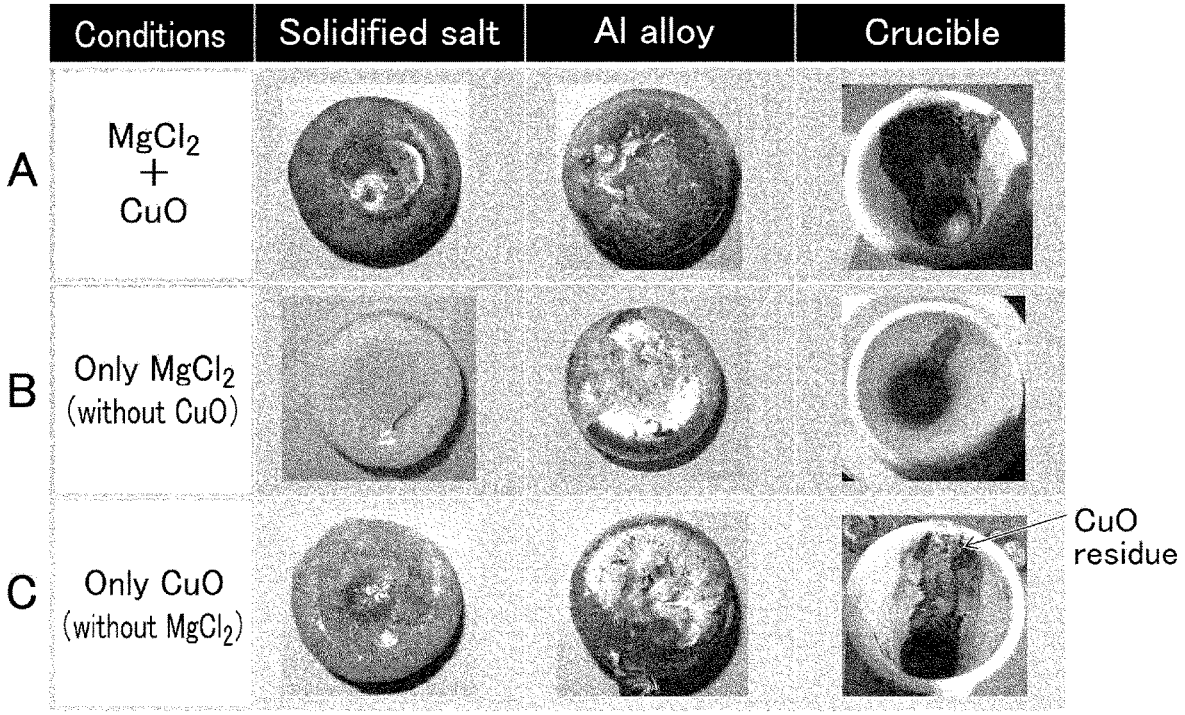

[Fig. 5]
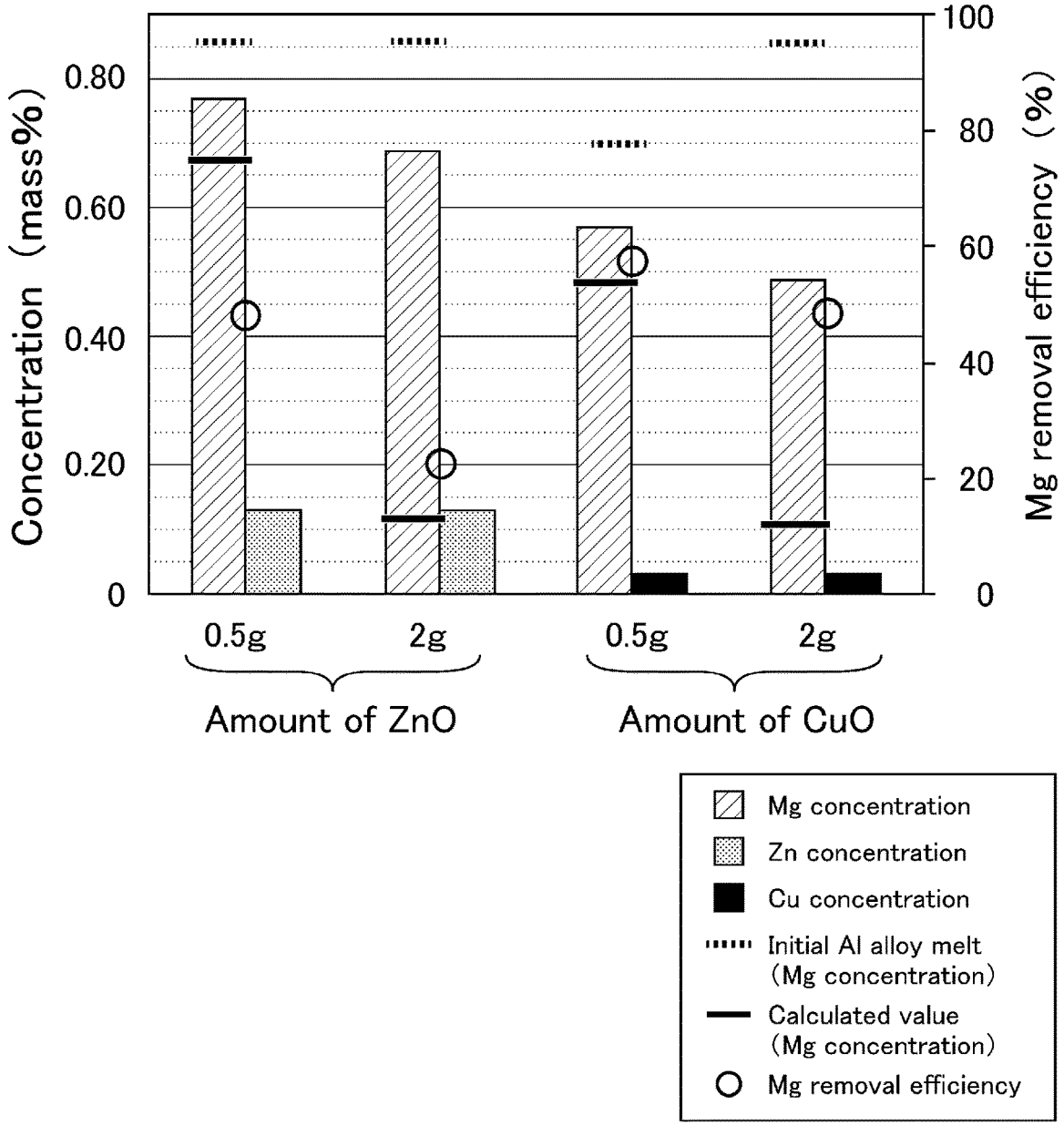

[Fig. 6A]
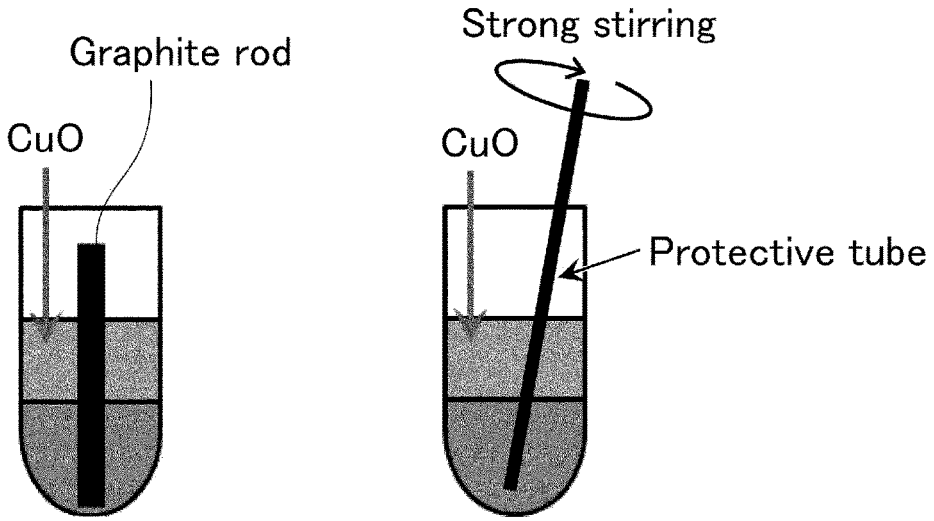
[Fig. 6B]
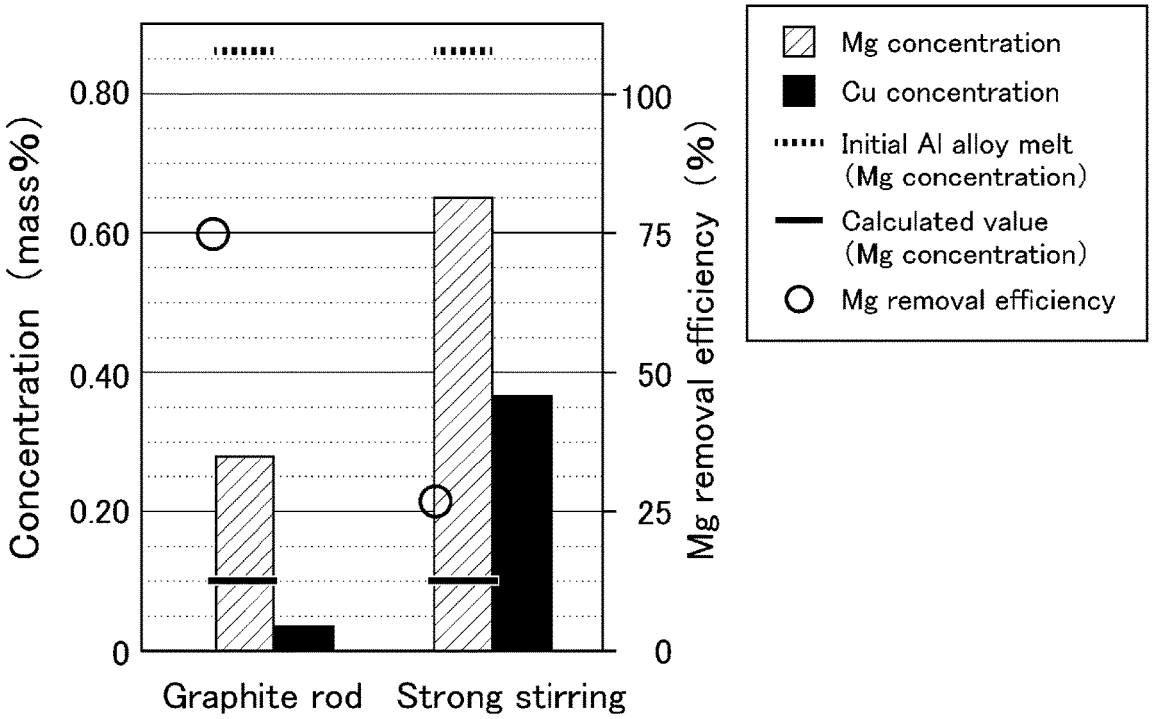

[Fig. 6C]
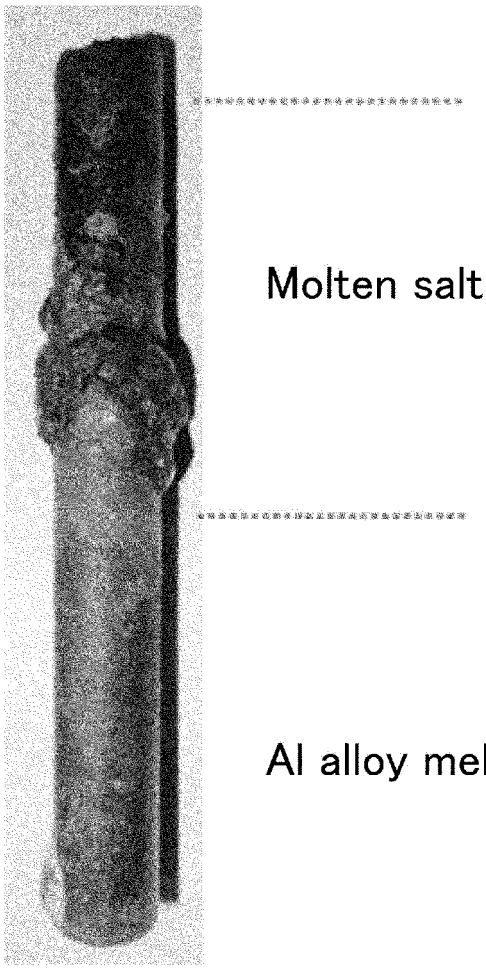

[Fig. 7A]
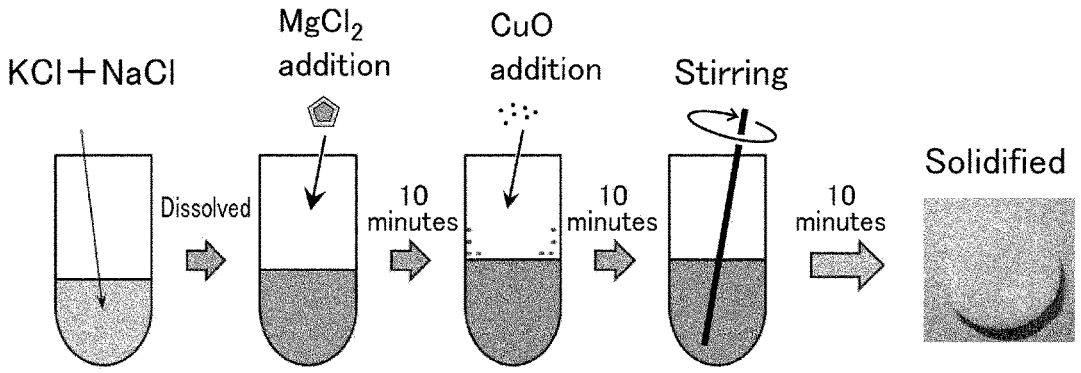
[Fig. 7B]
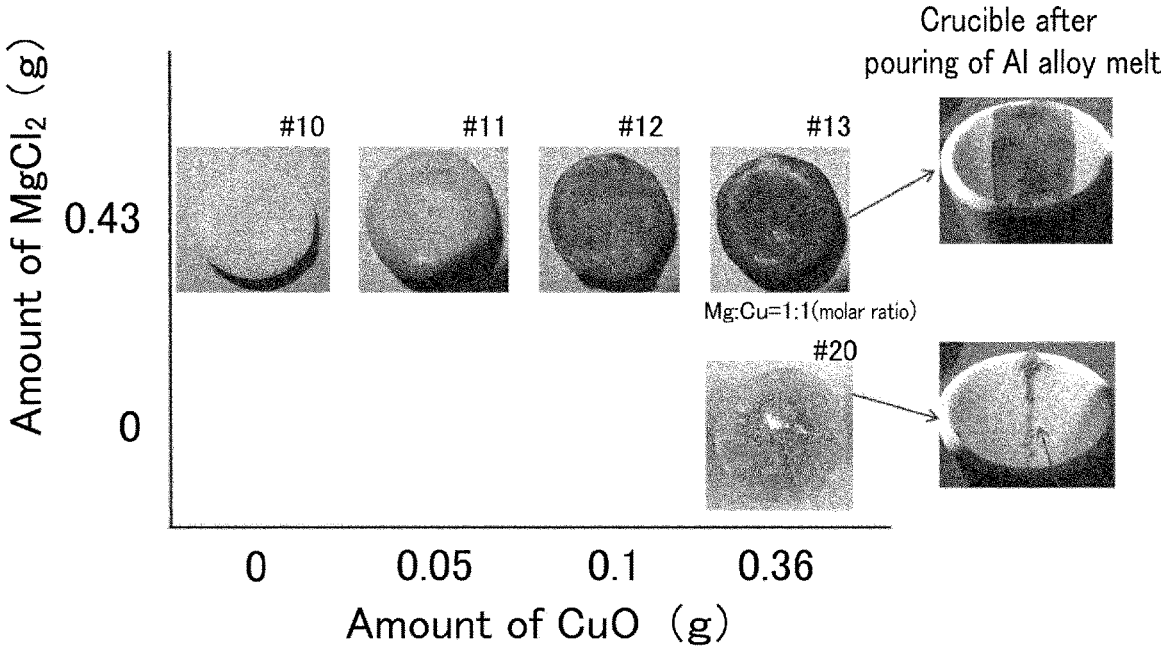

[Fig. 8A]
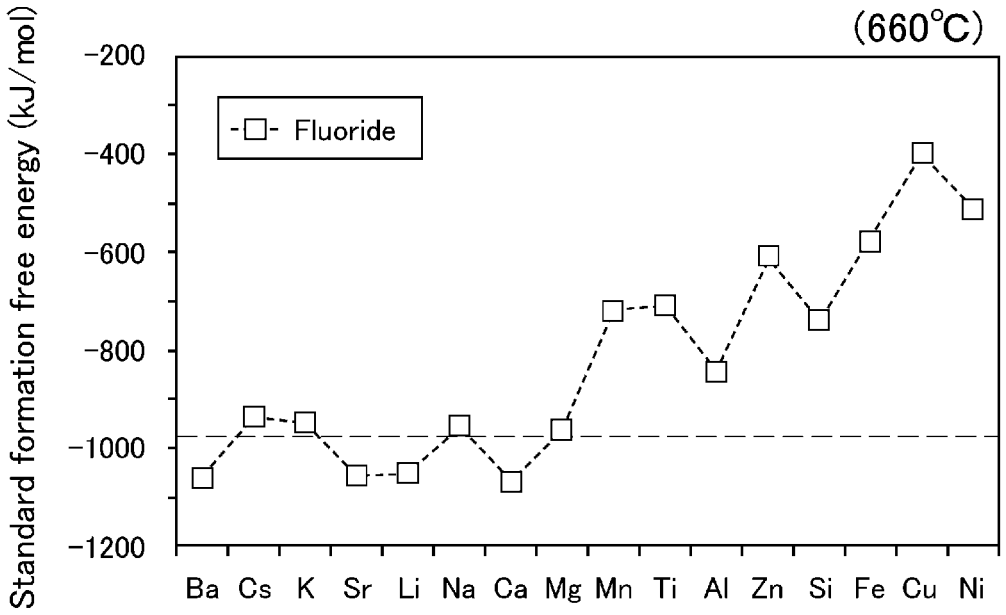
[Fig. 8B]
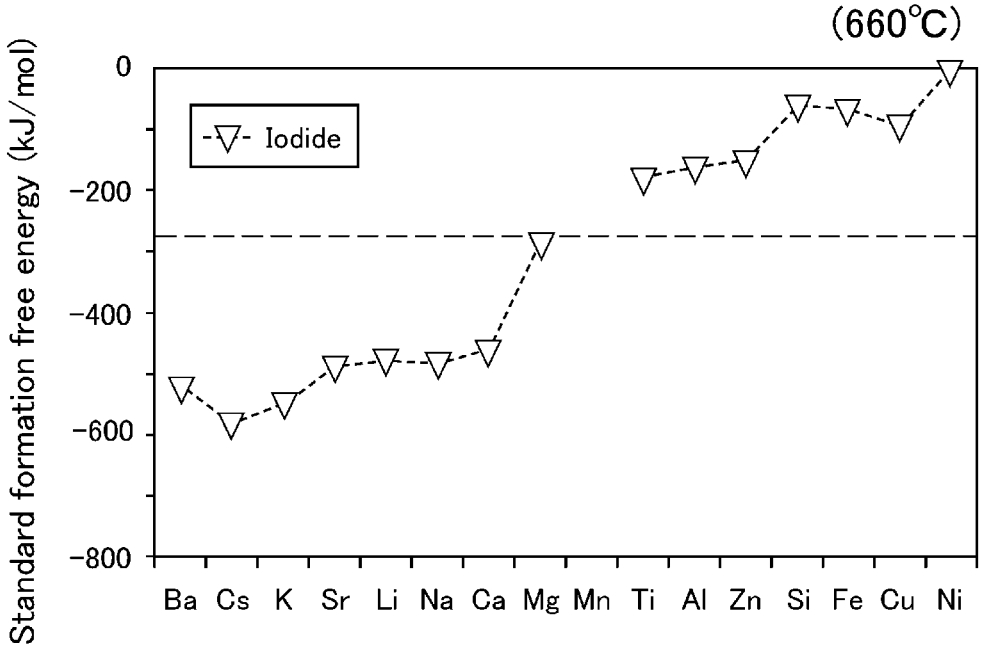

METAL REMOVAL METHOD AND METAL RECOVERY METHOD

TECHNICAL FIELD

The present invention relates to a method of removing Mg from aluminum alloy melt and relevant techniques.

BACKGROUND ART

With rise in environmental awareness, lightweight aluminum components are being used in various fields. By using recycled scrap instead of primary aluminum, it is possible to reduce energy consumption and environmental loads, promoting the use of aluminum components.

When scrap is melted, however, various elements other than Al tend to dissolve in the molten metal. To prepare a melt with desired composition, unnecessary or excess elements must be removed from the molten metal after melting of scrap (also referred to as a "Al alloy melt"). it is necessary to remove unnecessary or excess elements from the raw material molten metal obtained by melting scrap (also referred to as a "molten Al alloy"). As an example, there are descriptions related to the removal of Mg in the following documents.

CITATION LIST

Patent Literature

PTL 1: U.S. Pat. No. 4,097,270B
PTL 2: JP2007-154268A
PTL 3: JP2008-50637A
PTL 4: JP2011-168830A

Non Patent Literature

NPL 1: Journal of Japan Institute of Light Metals, vol. 33 (1983), pp. 243-248
NPL 2: Journal of Japan Institute of Light Metals, vol. 54 (2004), pp. 75-81

SUMMARY OF INVENTION

Technical Problem

PTL (Patent Literature) 1 describes a method (a type of metal oxide method) in which an Al alloy melt containing Mg is reacted with silica ($SiO_2$) ($2Mg+SiO_2 \rightarrow 2MgO+Si$) to remove Mg as MgO.

PTL 2 proposes a method in which pellets containing aluminum borate ($9Al_2O_3 \cdot 2B_2O_3$) are added to an Al alloy melt containing Mg to cause Mg to adhere onto the pellets and Mg is removed as a reaction product ($MgAl_2O_4$).

PTL 3 and 4 propose a method in which powdered battery residues obtained by roasting a used dry battery are added to a molten Al alloy containing Mg to remove Mg. The main components of battery residues are ZnO and $MnO_2$, and Mg is removed as a reaction product of these oxides and Mg (MgO, $MgMn_2O_4$, or $MgMnO_3$). The chloride contained in the battery residues enhances the wettability of these oxides with the molten Al alloy to promote the generation of the reaction product. Note, however, that the battery residues of alkaline dry batteries have a lower chloride content than that in the battery residues of manganese dry batteries. In this regard, PTL 4 proposes adding a mixed salt of KCl and NaCl into the molten Al alloy to replenish chloride.

NPL (Non Patent Literature) 1 and 2 describe chlorine gas methods and flux methods. In the chlorine gas method, gases such as chlorine, hexachlorethane, or carbon tetrachloride blown into an Al alloy melt reacts with Mg ($Mg+Cl_2 \rightarrow MgCl_2$), and Mg is removed as $MgCl_2$.

In the flux method (a type of metal halide method), flux (such as $AlF_3$, $NaAlF_4$, or $K_3AlF_6$) added to a molten Al alloy reacts with Mg (e.g., $3Mg+2AlF_3 \rightarrow 3MgF_2+2Al$), and Mg is removed as $MgF_2$. To improve the wettability of the flux with the molten Al alloy, chloride or the like can be added.

The above methods are common in that Mg is removed as an oxide (such as MgO) or a halide (such as $MgCl_2$ or $MgF_2$) generated by a chemical reaction in the Al alloy melt. In such a method, the substances used for the Mg removal and reaction products may readily remain as inclusions in the Al alloy melt. Moreover, in the conventional methods, Al trapped in by-products (such as dross (mainly $Al_2O_3$) and $AlCl_3$) is likely to be a loss, and a large amount of waste generated in addition to Mg oxides and halides. Furthermore, in the chlorine gas method and the flux method, $AlCl_3$ having a high vapor pressure and the exothermic components in the flux become fume, and therefore facilities for ensuring the safety and working environment are required.

The present invention has been made in view of such circumstances and an object of the present invention is to provide a method of removing Mg from an aluminum alloy melt and relevant techniques using different schemes than the conventional schemes.

Solution to Problem

As a result of intensive studies to achieve the above object, the present inventors have successfully removed Mg through bringing an Al alloy melt into contact with a molten salt layer formed on the surface of the aluminum alloy melt and taking in Mg into the molten salt layer. Developing this achievement, the present inventors have accomplished the present invention, which will be described hereinafter.

<<Metal Removal Method>>

(1) The present invention provides a metal removal method including a processing step of forming a molten salt layer in contact with an Al alloy melt containing Mg which covers at least a part of the surface of the Al alloy melt. The molten salt layer contains a specific halogen element that is one or more of Cl or Br and a specific metal element that is one or more of Cu, Zn, or Mn. The metal removal method further includes removing Mg by taking in Mg from the Al alloy melt to the molten salt layer side.

(2) In the metal removal method (also referred to as a "Mg removal method" or simply as a "removal method") of the present invention, Mg contained in the aluminum alloy melt (also referred to as an "Al alloy melt") is removed by being taken into the molten salt layer side through the contact interface between the Al alloy melt and the molten salt layer. According to this method, the Al loss and waste are reduced, and Mg can be removed efficiently or at low cost. Moreover, deterioration of working environment can be avoided because chlorine gas and the like are not used or generated.

The removal method of the present invention is not limited to being used for regeneration of aluminum scrap and can be used for preparation of various Al alloy melts. Moreover, the use of the removal method of the present invention allows to obtain a regenerated Al alloy having a desired composition to be obtained in a short time and efficiently from inexpensive scrap such as one with high Mg content. Accordingly, the metal removal method of the present invention is also perceived as a "method of producing a recycled Al alloy." The recycled Al alloy after the Mg removal can be used as a solidified material (such as an ingot) or a molten metal (including a semi-molten state).

<<Metal Recovery Method>>

The present invention is also perceived as a method of recovering the specific metal element used in the above-described removal method. That is, the present invention may also provide a metal recovery method including a processing step of forming a molten salt layer in contact with an Al alloy melt containing Mg which covers at least a part of the surface of the Al alloy melt. The molten salt layer contains a specific halogen element that is one or more of Cl or Br and a specific metal element that is one or more of Cu, Zn, or Mn. The metal recovery method further includes disposing a conductor at least near a contact interface between the aluminum-based molten metal and the molten salt layer to deposit and recover the specific metal element on the conductor. The conductor bridges the aluminum alloy melt and the molten salt layer.

According to the metal recovery method (also simply referred to as a "recovery method") of the present invention, the specific metal element used for the Mg removal can be efficiently recovered. By reusing the recovered specific metal element, it is possible to reduce the amount of waste formed due to the Mg removal. Moreover, it may also be possible to recover an expensive specific metal element (pure metal) while using an inexpensive specific metal element compound (such as oxide) for the Mg removal. The recovery method of the present invention can therefore contribute to the cost reduction of Mg removal on the whole.

<<Metal Removal Agent>>

The present invention is also perceived as a metal removal agent used for formation (or preparation) of the above-described molten salt layer. This will be specifically described below.

(1) The present invention may also provide a metal removal agent used for formation of a molten salt layer that takes in Mg from an Al alloy melt. The metal removal agent contains: a specific metal element that is one or more of Cu, Zn, or Mn; a specific halogen element that is one or more of Cl or Br; and Mg.

In the metal removal agent (also referred to as a "Mg removal agent" or simply as a "removal agent"), all or part of the specific metal element and Mg may be present, for example, as an oxide and/or a halide. In this case, the oxide of Mg (MgO) may be a reaction product of an oxide of a specific metal element (M) (specific metal oxide: MO) and a Mg halide ($MgX_2$).

In the removal agent, the amount of the specific metal element in a molar amount may be the same as the amount of Mg or may also be more or less than the amount of Mg. When the amount of the specific metal element in a molar amount is more than the amount of Mg, at least a part of the specific metal element may be an oxide. When the amount of the specific metal element in a molar amount is less than the amount of Mg, the specific metal element as a whole may be a halide. The removal agent may further contain a base halide that serves as a base material of the molten salt layer.

(2) The present invention may also provide a metal removal agent used for formation of a molten salt layer that takes in Mg from an Al alloy melt. The metal removal agent contains: base halides that serve as base materials of the molten salt layer; and specific metal halides that are a compound of specific metal elements and specific halogen elements. The specific metal element is one or more of Cu, Zn, or Mn and the specific halogen element is one or more of Cl or Br.

(3) By using any of these removal agents, the molten salt layer required for carrying out the above-described methods of removing Mg and recovering a specific metal element can be efficiently formed. Note, however, that it is not necessary to form the molten salt layer only with the removal agent. Depending on the situation of carrying out the removal method or the recovery method, a specific metal oxide, a Mg halide, a specific metal halide, a base halide, etc. may be replenished or used in combination as appropriate.

The form of the removal agent may be, for example, any of a massive form, a powdered form, a layered form, and other similar forms. At the form of the removal agent, the constituents (such as a specific metal oxide, a Mg halide, a specific metal halide, and a base halide) may not be uniformly mixed. In the present specification, each substance that constitutes the removal agent or a substance that is effective in carrying out the removal method and the recovery method is referred to as a "removal material." The "removal agent" is a mixture or a composition obtained by formulating, blending, or preparing such substances (elemental substances, compounds, etc.) or performing other similar procedures.

<<Others>>

(1) Unless otherwise stated, the concentration and composition as referred to in the present specification are indicated by the mass ratio (mass %) of an object (such as a molten metal or a composition) to the whole. The mass % is simply indicated by "%" as appropriate.

(2) The Al alloy melt or molten salt layer as referred to in the present specification includes a solid-liquid coexistence state (semi-molten state). The Al alloy melt contains Al as the main component (the Al content exceeds 50 atomic % in an embodiment, 70 atomic % or more in another embodiment, or 85 atomic % or more in still another embodiment with respect to the molten metal as a whole), and the specific composition is not limited, provided that it contains Mg. The amount of Mg in the raw material molten metal (Al-based molten metal before the removal of Mg) is not limited, but is usually about 10 mass % or less in an embodiment or about 5 mass % or less in another embodiment with respect to the molten metal as a whole.

(3) Unless otherwise stated, a numerical range "x to y" as referred to in the present specification includes the lower limit x and the upper limit y. Any numerical value included in various numerical values or numerical ranges described in the present specification may be selected or extracted as a new lower or upper limit, and any numerical range such as "a to b" can thereby be newly provided using such a new lower or upper limit.

BRIEF DESCRIPTION OF DRAWINGS

FIG. 1A is a standard formation free energy diagram of metal oxides and metal chlorides at 660° C.

FIG. 1B is a standard formation free energy diagram of metal oxides and metal bromides at 660° C.

FIG. 2A is a model diagram illustrating a mechanism with which Mg is taken into a molten salt layer from an Al-based molten metal.

FIG. 2B is a model diagram illustrating a mechanism with which a specific metal element (e.g., Cu) is deposited on a conductor.

FIG. 3A is a set of schematic views illustrating a Mg removal step using a molten salt layer containing $CuCl_2$ and photographs showing solidified materials (solidified salt and Al alloy).

FIG. 3B is a graph illustrating the relationship between the Mg concentration, Cu concentration, or Mg removal efficiency and the amount of $CuCl_2$.

FIG. 4A is a set of schematic views illustrating a Mg removal step using a molten salt layer containing $MgCl_2$ and CuO and photographs showing solidified materials.

FIG. 4B is a graph illustrating the relationship between the Mg concentration or Cu concentration and the amount of CuO.

FIG. 4C is a set of photographs showing the effect of $MgCl_2$ and CuO on solidified materials.

FIG. 5 is a graph illustrating the relationship between the Mg concentration, Cu concentration, or Mg removal efficiency and the amount of ZnO or CuO.

FIG. 6A is a set of schematic views illustrating Mg removal steps by insertion of a graphite rod or strong stirring.

FIG. 6B is a graph illustrating the relationship between the Mg concentration, Cu concentration, or Mg removal efficiency and the insertion of a graphite rod or strong stirring.

FIG. 6C is a photograph showing the appearance of a graphite rod after a Mg removal step (Cu recovery step).

FIG. 7A is a set of schematic views illustrating a preparation step for a Mg removal agent.

FIG. 7B is a set of photographs showing the relationship between the amounts of $MgCl_2$ and CuO and the appearances of solidified mixed salts.

FIG. 8A is a standard formation free energy diagram of metal fluorides at 660° C.

FIG. 8B is a standard formation free energy diagram of metal iodides at 660° C.

DESCRIPTION OF EMBODIMENTS

One or more features freely selected from the present specification can be added to the above-described features of the present invention. The content described in the present specification can be features regarding a product (e.g., regenerated Al alloy (molten metal)) even if the content represents methodological features.

<<Principle of Mg Removal>>

The principle with which Mg is removed from an Al alloy melt by the removal method of the present invention is considered as follows.

(1) Redox Reaction (Electrochemical Reaction)

Mg in the Al alloy melt is oxidized to $Mg^{2+}$ as follows and dissolves in the molten salt layer from the contact interface (the molten metal surface of the Al-based molten metal).

$$\text{Anode reaction: } Mg \rightarrow Mg^{2+} + 2e^- \quad (10a)$$

On the other hand, the divalent metal ion ($M^{2+}$) of the specific metal element (one or more of M=Cu, Zn, Mn) in the molten salt layer is reduced as follows and precipitated in the molten salt layer (including the vicinity of the contact interface with the Al-based molten metal).

$$\text{Cathode reaction: } M^{2+} + 2e^- \rightarrow M \quad (10b)$$

(2) Mg Halide

The specific halogen element (X=Cl and/or Br) exists as a monovalent halogen ion ($X^-$) in the molten salt layer, and the above-described redox reaction is therefore represented as follows.

$$MX_2 + Mg \rightarrow M + MgX_2 \quad (11)$$

Here, the standard formation free energy (also simply referred to as "free energy") of halides (chlorides and bromides) of various metal elements is as illustrated in FIG. 1A or FIG. 1B (these figures are collectively referred to as "FIG. 1"). FIG. 1 also illustrates the free energy of oxides of various metal elements. Each free energy illustrated in FIG. 1 relies on Knacke O., Kubaschwski O., Hesselmann K., "Thermochemical Properties of Inorganic Substances" (1991), SPRINGER-VERLAG. The same applies to the free energy illustrated in FIGS. 8A and 8B (these figures are collectively referred to as "FIG. 8"), which will be described later. FIGS. 1 and 8 illustrate each free energy at 660° C. The tendency (magnitude relationship) of each free energy at least at 660° to 800° C. is the same as that of each free energy illustrated in FIGS. 1 and 8.

As apparent from FIG. 1, all of the halides (specific metal halides) each composed of a specific metal element (M) and a specific halogen element have a larger free energy than that of the Mg halide. Formula (11) or Formula (10a)/(10b) therefore proceeds in a stable direction in which the free energy difference is negative ($\Delta G<0$), that is, from the left side to the right side. Thus, Mg is taken into the molten salt layer from the Al alloy melt as $Mg^{2+}$ and removed. In this reaction, the specific metal element having constituted the specific metal halide ($MX_2$), which is the Mg removal material, is precipitated as an elemental substance (M) and can be recovered, for example, by the above-described method.

(3) Mg Oxide

It is also possible to add an oxide of a specific metal element (specific metal oxide) as the Mg removal material to the molten salt layer to remove Mg from the Al alloy melt. In this case, the specific metal oxide (MO) undergoes the following reaction in the molten salt layer which contains Mg ($Mg^{2+}$) and the specific halogen element ($X^-$).

$$MO + MgX_2 \rightarrow MX_2 + MgO \quad (12)$$

As apparent from FIG. 1, the specific metal oxide (MO) has a larger free energy than that of the specific metal halide ($MX_2$). On the contrary, the Mg oxide (MgO) has a smaller free energy than that of the Mg halide ($MgX_2$) (see the enlarged part of FIG. 1A). Formula (12) therefore proceeds in a stable direction in which the free energy difference is negative ($\Delta G<0$), that is, from the left side to the right side. In particular, MgO has a smaller free energy than that of $MgX_2$ and is stable in the molten salt layer, so does not return to $MgX_2$. Thus, $Mg^{2+}$ in the molten salt layer is consumed (removed) as MgO.

On the other hand, $MX_2$ generated along Formula (12) serves as a Mg removal material as represented in Formula (11) and causes $Mg^{2+}$ taken into the molten salt layer from the Al alloy melt to be $MgX_2$. This $MgX_2$ further reacts with MO and becomes MgO as represented in Formula (12).

Owing to such circulation, the $Mg^{2+}$ concentration in the molten salt layer does not change, the molten salt layer which contains $MgX_2$ can be used almost permanently, and only the amount of $Mg^{2+}$ taken in from the Al-based molten metal is removed as MgO corresponding to the MO amount (molar amount). The situation in which Mg is removed in this way is schematically illustrated in FIG. 2A as an example of the case of M=Cu.

Thus, Mg can be removed at low cost using a specific metal oxide that is cheaper than a specific metal halide. Moreover, the use of a specific metal oxide allows Mg to be removed more reliably because Mg in the Al alloy melt is taken into the molten salt layer as stable MgO.

(4) Conductor

Mg in the Al-based molten metal is removed through the anode reaction represented by the previously described Formula (10a) and the cathode reaction represented by the previously described Formula (10b). Here, when a conductor that bridges the Al alloy melt and the molten salt layer is disposed, this is a similar configuration to that of a battery (galvanic battery) in which the Al-based molten metal side is the anode (electrode) side and the molten salt layer side is the cathode (electrode) side. The specific metal element is therefore concentrated and deposited on the surface of the conductor located on the molten salt layer side and can be efficiently recovered. Moreover, the deposited specific metal element is avoided from being mixed into the Al alloy melt side. Furthermore, the conductor can promote the electrochemical reactions represented by Formula (10a) and Formula (10b) to improve the deposition rate of the specific metal element and the removal rate of Mg.

The situation in which the specific metal element is deposited on the conductor in parallel with the removal of Mg in this way is schematically illustrated in FIG. 2B as an example of the case of M=Cu. FIG. 2B illustrates the case in which the conductor is an electrode rod, but the conductor may be in other forms. For example, the conductor may be composed of an electrode provided in the Al alloy melt, an electrode provided in the molten salt layer, and a conductor (such as a conductive wire) that electrically connects the two electrodes. Furthermore, a container body that holds the Al alloy melt and the molten salt layer may also serve as a conductor. For example, the container body itself may be made of a conductive material (such as metal), or a conductive material disposed on the inner wall of the container body at least in the vicinity of the melt surface (in the vicinity of the contact interface) may be used as the conductor.

Preferably, the conductor is made, for example, of a conductive material such as graphite or metal. At least a conductive portion that comes into contact with the Al-based molten metal is preferably insoluble in the Al alloy melt.

<<Specific Metal Element>>

On the basis of the free energy of the metal halides illustrated in FIG. 1, the specific metal element (M) may be other than Cu, Zn, or Mn. That is, even when the specific metal element is Ti, Al, Si, Fe, Ni, or the like, the electrochemical reaction represented by Formula (11) can proceed.

Note, however, that also considering the procession of the dissolution reaction of the metal oxide (MO) represented by Formula (12) in the molten salt layer, the specific metal element (M) is preferably one or more of Cu, Zn, or Mn. This can be understood from the free energy of metal oxides illustrated together in FIG. 1. In particular, when the specific metal element is Cu, the free energy of Cu halide is correspondingly smaller than that of Cu oxide, and the reaction represented by Formula (12) readily proceeds in the molten salt layer.

The free energy of metal oxides illustrated in FIG. 1 is intended for CuO, ZnO, MnO, and the like. The specific metal oxide is therefore preferably one or more of CuO, ZnO, or MnO.

<<Specific Halogen Element>>

Other than Cl or Br, F and I can be used as the halogen element (X). As illustrated in FIG. 8A, however, the free energy of $MgF_2$ is very small and $MgF_2$ is stable. Accordingly, when X=F, the reaction represented by Formula (12) is less likely to proceed in the molten salt layer.

On the contrary, as illustrated in FIG. 8B, the free energy of iodide of the specific metal element is large, and the difference in the free energy from that of the specific metal oxide is small. Accordingly, when X=I, the reaction represented by Formula (12) does not necessarily proceed stably in the molten salt layer. In consideration of such circumstances, the specific halogen element (X) is preferably Cl and/or Br.

<<Base Material/Base Halide of Molten Salt Layer>>

The molten salt layer preferably has a base material, for example, of a stable metal halide. For example, as illustrated in FIG. 1, the base material (base halide) of the molten salt layer is preferably Mg halide or halide of a metal element (one or more of Ca, Na, Li, Sr, K, Cs, Ba, etc.) having a smaller free energy than that of the Mg halide. In particular, halides of Na and/or K are inexpensive and stable and are therefore suitable as the base halide. Furthermore, the base halide is preferably composed of a specific halogen element. The wider the contact area between the Al alloy melt and the molten salt, the more improved the reaction efficiency, but the molten salt layer does not necessarily cover the entire surface of the molten metal.

<<Processing Step/Removal Step>>

The processing step is to form a molten salt layer that is in contact with the surface of the Al alloy melt and covers at least a part of the melt surface. By retaining the state in which the molten salt layer and Al alloy melt prepared or maintained at desired components are in direct contact with each other, Mg is taken into the molten salt layer from the Al-based molten metal and removed (removal step).

When the Mg removal material ($MX_2$, MO) is sufficiently present in the molten salt layer, the Mg concentration in the Al-based molten metal can be reduced as the retaining time increases. Note, however, that an excessive holding time is not realistic. The holding time is therefore preferably, for example, 1 to 180 minutes in an embodiment or 15 to 90 minutes in another embodiment. Furthermore, each process (step) is not limited to the batch type and may be performed continuously.

Preferably, the molten salt layer covers the entire surface of the Al alloy melt and has an amount (thickness) that allows sufficient Mg to be taken in from the Al alloy melt. For example, the thickness of the molten salt layer is preferably 3 mm or more.

The molten salt layer is prepared, for example, as follows. First, the base molten salt layer in which the base halide (base material) is dissolved is formed on the Al alloy melt. Due to the difference in density, the base molten salt layer is located on the upper layer side of the Al alloy melt. Then, the Mg removal material (such as specific metal halide, Mg halide, or specific metal oxide) is added to the base molten salt layer to prepare a molten salt layer that contains desired substances (such as elements and ions).

The Mg removal material is preferably supplied to the molten salt layer temporarily, intermittently, or continuously in consideration of the concentration of Mg contained in the Al alloy melt, the processing amount of the Al-based molten metal, etc. When the conductor is disposed between the Al alloy melt and the molten salt layer (at least near the contact interface), the Mg removal material is preferably supplied to around (near) the conductor. This allows the recovery of the specific halogen element and the removal of Mg to be performed more efficiently.

EXAMPLES

Molten salt layers were brought into contact with Al alloy melt containing Mg. Each solidified material (Al alloy, solidified salt) after the contact was observed, and the Mg concentration in each Al alloy was measured. The present invention will be described in more detail based on such specific examples.

<<Overview of Experiment>>

(1) Al Alloy Melts

Al alloys having a component composition of Al-0.87% Mg or Al-0.7% Mg were prepared as Al alloy melts (raw material molten metals) to be objects of removing Mg. The Mg concentration is the mass ratio of Mg to the entire melt. Commercially available pure Al and pure Mg were used as the metal raw materials to be the Al alloy melts. The amount of Al-based molten metal used for each sample was 80 g.

(2) Molten Salts

The following halides and oxide were prepared as raw materials for the molten salts. Commercially available reagents were used for all the raw materials.

Base halide: NaCl and KCl (mixed salt with a molar ratio of 1:1)

Specific metal halide: $CuCl_2$

Specific metal oxide: CuO (copper oxide (II)) or ZnO (zinc oxide)

The amount of base halide used for each sample was 29.6 g.

(3) Melting

The Al alloy melts and the molten salt layers were all prepared by heating each raw material in a Tammann tube (SSA-H-T6 available from Nikkato Corporation) as a crucible. The heating was performed using an electric furnace (cylindrical-shaped furnace) accommodating the Tammann tube (inner diameter: ϕ34 mm, outer diameter: ϕ40 mm, height: 150 mm). The temperature at the time of melting was set to 700° C. or 750° C., and the temperature at the time of holding was set to 700° C., 720° C., or 730° C.

(4) Analysis/Observation

Analysis/observation was carried out using disk-shaped solidified materials obtained through pouring the Al alloy melts and the molten salts into cylindrical molds (stainless steel molds for analysis) and then naturally cooling and solidifying them in the air. In the present example, for descriptive purposes, the solidified material of each Al alloy melt is referred to as an "Al alloy," and the solidified material of each molten salt is referred to as a "solidified salt."

Chemical components (Mg concentrations, Cu concentrations) of the Al alloys were analyzed by fluorescent X-ray spectroscopy. Compositions (concentrations) of the Al alloys are each a mass ratio to the entire Al alloy. Appearances of the Al alloys were visually observed. Colors of the solidified salts were visually observed.

Example 1

Each molten salt layer was obtained by adding a specific metal halide (Mg removal material) to a base molten salt (layer) composed of a base halide, and the Mg removal efficiency of the molten salt layer was investigated as follows.

(1) Processing

First, a weighed metal raw material (Al-0.87% Mg: 80 g) and a weighed base halide (mixed salt of NaCl and KCl: 29.6 g) were put into a crucible (Tammann tube) and heated at a set temperature of 750° C. The Al alloy melt and the base molten salt layer were thus formed as illustrated in FIG. 3A. The Al alloy melt and the base molten salt layer were separated into two layers due to the difference in the density (specific gravity), and the low-density base molten salt layer was located on the upper layer side of the Al alloy melt and covered the entire surface of the Al alloy melt.

Then, 0.5 g or 2 g of $CuCl_2$ was added onto the base molten salt layer to prepare a molten salt layer. After the addition, the temperature of the crucible was set to 730° C. and the crucible was held for 30 minutes. The obtained Al alloy melt and the molten salt layer were solidified in the mold for analysis, respectively, to obtain an Al alloy and a solidified salt.

(2) Evaluation

The solidified salt after the processing step was white. It is considered that the solidified salt was a mixed salt of $MgCl_2$, KCl, and NaCl.

The Mg concentration and Cu concentration in each Al alloy are illustrated in FIG. 3B. The actual measured value of Mg concentration decreased almost in accordance with the calculated value (stoichiometry) obtained from the additive amount of $CuCl_2$. It has thus been confirmed that the Mg removal efficiency is almost 100% in the case of the present example.

The calculated value of Mg concentration was obtained based on the molar ratio determined from Formula (11). The Mg removal efficiency (%) is the ratio ($100\times\Delta D/\Delta D_0$) of the amount of decrease in Mg concentration ($\Delta D$) obtained from the actual measured value to the amount of decrease in Mg concentration ($\Delta D_0$) obtained from the calculated value. The calculated value of concentration and the method of calculating the Mg removal efficiency are the same in the following examples.

The Cu concentration in the Al alloy was 0.05% or less in each case. From this fact, it has been found that Cu (specific metal element) contained in the Mg removal material is scarcely mixed in the Al alloy melt and stays in the molten salt layer (including the vicinity of the boundary with the Al alloy melt (vicinity of the contact interface)).

Example 2

Each molten salt layer was obtained by adding a Mg halide and a specific metal oxide (Mg removal material) to a base molten salt layer composed of a base halide, and the Mg removal efficiency of the molten salt layer was investigated as follows.

(1) Processing

First, a weighed metal raw material (Al-0.7% Mg: 80 g) and a weighed base halide (mixed salt of NaCl and KCl: 29.6 g) were put into a crucible (Tammann tube) and heated at a set temperature of 750° C. The base molten salt layer in contact with the Al alloy melt was thus formed as illustrated in FIG. 4A. This procedure is the same as in the case of Example 1.

Then, 0.43 g (0.0045 mol) of $MgCl_2$ was added onto the base molten salt layer, and the crucible was held at a set temperature of 730° C. for 10 minutes.

After that, CuO was further added to the base molten salt layer, which was held at the same temperature (730° C.). At that time, the amount of CuO added and the holding time were variously changed. During each holding time, light stirring to such an extent of rotating the crucible for about 3 seconds was performed three times (initial stage, middle stage, and late stage).

The Al alloy and the solidified salt were thus obtained from the Al alloy melt and the molten salt layer prepared by variously changing the amount of CuO and the holding time.

(2) Evaluation

The Mg concentration and Cu concentration in each Al alloy are summarized and illustrated in FIG. 4B. As apparent from FIG. 4B, the Mg concentration in the Al alloy decreased as the amount of CuO added to the base molten salt layer increased. However, as the amount of CuO increased, a longer time is required to decrease the Mg concentration. It is considered that the reason why the actual measured value of Mg concentration was higher than the calculated value is that CuO was consumed by some unexpected reaction products ($Al_2O_3$, $MgAl_2O_4$).

Also in the present example, the Cu concentration in the Al alloy was 0.05% or less in each case. That is, it has been confirmed that Cu contained in the Mg removal material is scarcely mixed in the Al alloy melt and stays in the molten salt layer.

(3) Effect of $MgCl_2$

For Sample A obtained by adding 0.43 g of $MgCl_2$ and 2.0 g of CuO to the base molten salt layer and setting the holding time to 10 minutes, Sample B obtained by adding only the $MgCl_2$, and Sample C obtained by adding only the CuO, appearances when observing the solidified salt (the supernatant portion of the molten salt), the Al alloy, and the bottom of the crucible are collectively shown in FIG. 4C.

The solidified salt of Sample A was gray or black. This is because Mg taken in from the Al alloy melt was removed as MgO (black) and remained in the molten salt layer.

Precipitated Cu (red) was observed on the Al alloy. Cu has a higher density and a higher melting point than those of the Al alloy. It is considered, however, that Cu was not mixed in the Al alloy melt because Cu was finely precipitated near the contact interface between the molten salt layer and the Al alloy melt.

The solidified salt of Sample B was almost white. Precipitation of Cu or the like was not observed on the Al alloy. From these, it has been confirmed that if CuO, which is a Mg removal material, is not added, the reaction represented by Formula (12) does not proceed and Mg is not removed.

Even when $MgCl_2$ was not added as in sample C, change in color of the solidified salt and Cu precipitation on the Al alloy were observed. However, the degree thereof was small as compared with Sample A, and a large amount of unreacted CuO remained at the bottom of the crucible. From these, it has been found that when $MgCl_2$ is preliminarily added to the molten salt layer, the reaction represented by Formula (12) is promoted and Mg is efficiently removed.

Example 3

(1) Processing

CuO used in Example 2 was changed to ZnO, and the same processing as in Example 2 was performed. At that time, Al-0.7% Mg molten metal (80 g) was used as the Al alloy melt. The temperature at the time of melting and holding was set to 700° C. The holding time after adding ZnO was 30 minutes. Other conditions were the same as in the case of Example 2.

(2) Evaluation

The Mg concentration and Zn concentration in each Al alloy obtained from the Al-based molten metal in contact with the molten salt layer to which ZnO was added were measured. The results are illustrated in FIG. 5. FIG. 5 also illustrates the Mg concentration and Cu concentration in each Al alloy of Example 2 using CuO.

As apparent from FIG. 5, Mg was able to be removed from the Al-based molten metal also when ZnO was used. However, the Mg removal efficiency was lower than that when CuO was used. This is considered to be because as illustrated in FIG. 1A, Zn has a smaller free energy difference between the oxide and the chloride than that of Cu and the procession of Formula (12) is moderate.

Moreover, the Zn concentration when using ZnO was higher than the Cu concentration when using CuO. It is considered that a part of Zn (see Formula (11)) precipitated in the molten salt layer was mixed in the Al alloy melt because the melting point of Zn (about 420° C.) is lower than the melting point of Cu (about 1084° C.).

Example 4

(1) Processing

In the same manner as in Example 2, 0.43 g of $MgCl_2$ was added to the base molten salt layer at a set temperature of 750° C. and held for 10 minutes, and then 2 g of CuO was further added. After that, as illustrated in FIG. 6A, a graphite rod (conductor) was inserted into the crucible and held at a set temperature of 730° C. for 30 minutes.

As a comparative example, as illustrated in FIG. 6A, a sample was also prepared for which after adding CuO, the molten salt layer and the Al alloy melt were strongly stirred with a protective tube (made of ceramics) as substitute for the insertion of a graphite rod. Strong stirring was performed after 10 minutes, 20 minutes, and 30 minutes elapsed from the addition of CuO.

(2) Evaluation

The Mg concentration and Cu concentration in the Al alloy obtained from the Al-based molten metal after each processing were measured. The results are illustrated in FIG. 6B. As apparent from FIG. 6B, the insertion of the graphite rod improved the Mg removal efficiency and reduced the Cu concentration. This is apparent not only in comparison with the case of strong stirring but also in comparison with the cases illustrated in FIGS. 4B and 5. This is considered to be because the reaction of Formula (11) mainly occurred on the graphite rod (conductor) and the oxidation of Al or the like near the contact interface between the Al alloy melt and the molten salt layer was suppressed.

It has also been confirmed that the strong stirring during the processing tends to increase the Mg concentration and the Cu concentration because the Mg ($Mg^{2+}$, MgO) taken into the molten salt layer and the precipitated Cu easily mixed in the Al alloy melt.

FIG. 6C shows a photograph of the graphite rod extracted from the Al alloy melt and the molten salt layer after 30 minutes elapsed from the addition of CuO. As apparent from FIG. 6C, a large amount of Cu was deposited on the molten salt layer side, particularly on the lower part thereof (the upper part just above the boundary with the Al alloy melt). It has been found that when the graphite rod (conductor) is used during the Mg removal step, the regions in which the cathode reaction and the anode reaction occur are separated (controlled), and the recovery step for the specific metal element (Cu) becomes more efficient. Cu located on the Al alloy melt side of the graphite rod illustrated in FIG. 6C was attached when the graphite rod was extracted.

Example 5

A base halide (NaCl+KCl), a Mg halide ($MgCl_2$), and a specific metal oxide (CuO) were blended to produce each of various mixed salts (solid/Mg removal agent) used for preparation of molten salt layers. This will be specifically described. Unless otherwise stated, each mixed salt was produced in the same manner as for the solidified salt of the molten salt layer described in Example 2.

(1) Processing

As illustrated in FIG. 7A, a weighed mixed salt (29.6 g) of NaCl and KCl was put into a crucible (Tammann tube as described above) and heated at a set temperature of 750° C. $MgCl_2$ and/or CuO was added onto the base molten salt layer thus obtained.

The additive amount of $MgCl_2$ was 0 g (without addition) or 0.43 g (0.0045 mol). The additive amount of CuO was any of 0 g (without addition), 0.05 g, 0.1 g, and 0.36 g (0.0045 mol). The addition of CuO was performed after adding $MgCl_2$ and holding for 10 minutes. After the addition of CuO, it was further held for 10 minutes. The set temperature during the holding was 720° C. in each case. Thus, a plurality of molten salts was prepared. Each molten salt was sufficiently stirred and was poured into an mold for analysis and solidified by natural cooling in the air. The appearance of each disk-shaped mixed salt is summarized and illustrated in FIG. 7B.

(2) Evaluation

The following facts are found from the color of each mixed salt illustrated in FIG. 7B. First, the mixed salt (#10) of $MgCl_2$: 0.43 g and CuO: 0 g (without addition) was white. As the additive amount of CuO increased, the mixed salts (#11 to #13) changed from gray to black. Black is due to MgO.

Then, the mixed salt (#20) of $MgCl_2$: 0 g (without addition) and CuO: 0.36 g was also basically colorless and transparent. The slightly yellow part seen in the mixed salts is due to $Cu^{2+}$ formed by a very small amount of CuO dissolved. At that time, most of CuO was attached to the inner wall surface of the crucible. The mixed salt (#13) having a molar ratio of $MgCl_2$ and CuO of 1:1 was black.

As apparent from comparing the mixed salt (#20) to which $MgCl_2$ was not added with other mixed salts, it is found that the presence of $Mg^{2+}$ increases amounts of dissolved CuO. That is, the reaction represented by Formula (12) is promoted. The mixed salt obtained by adding the Mg halide and the specific metal oxide is therefore effective as the Mg removal agent (metal removal agent).

When the specific metal oxide is less than $Mg^{2+}$ (Mg halide) in the stoichiometric proportion, the mixed salt (metal removal agent) obtained as described above is substantially composed of a base halide, a Mg halide, a specific metal halide, and a Mg oxide. The specific metal halide ($CuCl_2$) contributes to the Mg removal as described in Example 1. When further removing Mg from the Al alloy melt, it is preferred to supply, as needed, a specific metal oxide (such as CuO) to the molten salt layer formed by using the metal removal agent.

From the above, according to the metal removal method of the present invention, Mg can be efficiently removed from the Al alloy melt. Moreover, according to the metal recovery method of the present invention, the specific metal element used when removing Mg can be efficiently recovered. Furthermore, the use of the metal removal agent of the present invention allows the molten salt layer to be efficiently formed, which is used when removing Mg.

The invention claimed is:

1. A metal removal method comprising a processing step of forming a molten salt layer in contact with an aluminum alloy melt containing Mg which covers at least a part of the surface of the aluminum alloy melt, the molten salt layer containing a specific halogen element that is one or more of Cl or Br and a specific metal element that is one or more of Cu or Mn, the metal removal method further comprising removing Mg by taking in Mg from an aluminum alloy melt side to a molten salt layer side, and disposing a conductor that bridges the aluminum alloy melt and the molten salt layer such that at least a conductive portion of the conductor comes into contact with the aluminum alloy melt, wherein the conductor is an electrode rod.

2. The metal removal method according to claim 1, wherein the specific metal element is supplied as an oxide to the molten salt layer.

3. The metal removal method according to claim 1, wherein the molten salt layer contains Mg.

4. The metal removal method according to claim 1, wherein the specific metal element is supplied from the molten salt layer side to around the conductor.

5. The metal removal method according to claim 1, wherein the specific metal element is Cu.

6. The metal removal method according to claim 1, wherein a base material of the molten salt layer is a halide of Na and/or K.

7. The metal recovery method according to claim 1, wherein the specific metal element is deposited on the conductor, which is insoluble in the Al alloy melt.

8. A metal recovery method comprising a processing step of forming a molten salt layer in contact with an aluminum alloy melt containing Mg which covers at least a part of the surface of the aluminum alloy melt, the molten salt layer containing a specific halogen element that is one or more of Cl or Br and a specific metal element that is one or more of Cu or Mn, the metal recovery method further comprising disposing a conductor at least near a contact interface between the aluminum alloy melt and the molten salt layer to deposit and recover the specific metal element on the conductor, the conductor bridging the aluminum alloy melt and the molten salt layer such that at least a conductive portion of the conductor comes into contact with the aluminum alloy melt, wherein the conductor is an electrode rod.

9. The metal recovery method according to claim 8, performed in parallel with the metal removal method according to the processing step of forming the molten salt layer in contact with the aluminum alloy melt containing Mg which covers at least the part of the surface of the aluminum alloy melt, the molten salt layer containing the specific halogen element that is one or more of Cl or Br and the specific metal element that is one or more of Cu or Mn, the metal removal method further comprising removing Mg by taking in Mg from the aluminum alloy melt side to the molten salt layer side.

10. A metal removal method comprising a processing step of forming a molten salt layer in contact with an aluminum alloy melt containing Mg which covers at least a part of the surface of the aluminum alloy melt, the molten salt layer containing a specific halogen element that is one or more of Cl or Br and a specific metal element that is one or more of Cu or Mn, the metal removal method further comprising removing Mg by taking in Mg from an aluminum alloy melt side to a molten salt layer side, and disposing a conductor that bridges the aluminum alloy melt and the molten salt layer such that at least a conductive portion of the conductor comes into contact with the aluminum alloy melt, wherein the conductor is selected from (i) a conductive wire, (ii) a container body that holds the Al alloy melt and the molten salt layer, and (iii) a conductive material disposed on the inner wall of the container body.

* * * * *